United States Patent [19]

Lange

[11] 4,090,530

[45] May 23, 1978

[54] APPARATUS FOR MULTI-PHASE FLUID SYSTEMS

[75] Inventor: Norbert G. Lange, Sanborn, N.Y.

[73] Assignee: Hooker Chemicals & Plastics Corp., Niagara Falls, N.Y.

[21] Appl. No.: 719,002

[22] Filed: Aug. 30, 1976

Related U.S. Application Data

[63] Continuation-in-part of Ser. No. 645,509, Dec. 30, 1975, Pat. No. 3,987,816.

[51] Int. Cl.[2] ..... F03B 7/07

[52] U.S. Cl. ..... 137/563; 137/565; 137/574; 137/576; 204/238; 204/DIG. 1

[58] Field of Search ..... 137/563, 565, 574, 576; 204/234, 235, 237, 238, 240, DIG. 1; 134/30, 40

[56] References Cited

U.S. PATENT DOCUMENTS

| | | | |
|---|---|---|---|
| 1,455,927 | 5/1923 | Morison | 137/576 |
| 2,225,498 | 12/1940 | Hollander | 137/563 |
| 2,288,503 | 6/1942 | Weaver | 204/235 |
| 2,710,832 | 6/1955 | Harr | 204/DIG. 1 |
| 3,239,438 | 3/1966 | Voorhees | 204/235 |
| 3,247,969 | 4/1966 | Miller | 137/563 |
| 3,922,208 | 11/1975 | Cordone et al. | 204/238 |
| 3,987,816 | 10/1976 | Lange | 137/563 |

*Primary Examiner*—William R. Cline
*Assistant Examiner*—H. Jay Spiegel
*Attorney, Agent, or Firm*—Peter F. Casella; William J. Crossetta, Jr.; Arthur S. Cookfair

[57] ABSTRACT

An apparatus is provided wherein, in a static condition a lower phase liquid is covered by an upper phase liquid which is non-miscible with the lower phase liquid. In operation, the upper phase liquid is removed from a selected area of the lower phase liquid by raising the upper phase liquid to pass over a weir into a second chamber. Simultaneously a portion of the lower phase liquid is circulated over a second weir and caused to pass through a portion of the upper phase liquid to provide a scrubbing or cleansing action. When operation ceases the liquids automatically return to the static condition levels wherein the lower phase liquid is completely covered by the upper phase liquid. During operation articles or materials may be caused to enter and exit the lower phase liquid in the selected area, for treatment therein without contacting the upper phase liquid. The apparatus is useful in cleaning, degreasing, plating, pre-plating treatments and the like.

8 Claims, 6 Drawing Figures

APPARATUS FOR MULTI-PHASE FLUID SYSTEMS

This is a continuation-in-part of Ser. No. 645,509, now U.S. Pat. No. 3,987,816 filed Dec. 30, 1975.

BACKGROUND OF THE INVENTION

This invention relates to an apparatus for use with a multi-phase bath for cleaning, degreasing, plating, or pre-plating treatment of a substrate or similar type use. More particularly, it relates to an apparatus wherein items to be immersed in or exposed to lower phases of a multi-phase bath may enter and exit the lower phase fluid of the bath without coming in contact with the upper phase liquid.

A wide variety of industrial processes such as cleaning, degreasing, plating, or various pre-plating processes require the treatment of an article or material by immersion in a liquid bath. Liquid employed in such treatments are often highly volatile and frequency produce hazardous vapors. To minimize costly losses from evaporation as well as to minimize the exposure of operating personnel to harmful vapors, it is often desirable to maintain such liquid baths in a covered state, at least covered to an extent consistent with operating requirements. However, the use of a solid cover over such a liquid bath results in the disadvantage of obstructing the viewing of the internal portions of the bath as well as interfering with physical access to the interior portions of the bath. To avoid these disadvantages, some prior art processes provide a fluid covering over the bath. Typically, the fluid covering is a relatively non-hazardous, low-volatility, transparent liquid, such as water, which is of lower specific gravity and non-miscible with the lower liquid of the bath. Such a two phase fluid system permits easier viewing and more convenient access to the internal portions of the bath. One problem encountered in the use of such a two layer bath is that an article to be immersed in or exposed to the lower liquid, must also come in contact with the surface liquid. In some processes this may be permissible or even desirable. However, in other processes it is not desirable, for example, in instances where contact with the surface liquid may adversely affect the surface of the article being treated and prevent or inhibit the wetting action or other action of the lower liquid.

In such processes where it is desirable to immerse articles in the lower liquid without contact with the surface liquid it has generally been necessary to completely remove the surface liquid from all or a portion of the bath each time a working operation is started, and replace the surface liquid each time the working operation is discontinued. Manual removal of the surface liquid requires the expenditure of time and labor. Thus, it is desirable to provide a process and apparatus wherein this operation may be performed automatically. Furthermore, the complete removal of the surface liquid may result in the exposure of an unnecessarily large surface of the lower liquid with a consequent evaporative loss and the possible exposure of operating personnel to hazardous vapors. For this reason, it is desirable to provide a process and apparatus wherein the surface liquid may be conveniently and completely removed from a selected minimum area, the size of which is consistent with operating needs.

Accordingly, it is an object of this invention to provide an apparatus for use with multi-phase fluid systems wherein during operation an upper phase fluid may be automatically selectively removed from a portion of the surface of a lower phase fluid, while other portions of the surface remain covered with the upper phase fluid. It is another object of this invention to provide such an apparatus wherein, when the working operation is discontinued, the entire surface of the lower phase fluid is automatically completely covered with the upper phase fluid. It is another object to provide a process and apparatus for containing a multi-phase fluid system, wherein an article or material may enter and exit the lower phase fluid without contacting the upper phase fluid. It is still further object to provide such a system and apparatus wherein, during operation, the lower phase fluid may be continuously cleansed or scrubbed by the upper phase fluid.

SUMMARY OF THE INVENTION

This invention provides an apparatus for a multi-phase fluid system having an upper phase fluid and a lower phase fluid wherein, in a static condition the upper phase fluid substantially completely covers the upper surface of the lower phase fluid and in an operating condition the upper phase fluid is selectively removed from a portion thereof. The apparatus comprises (a) a working chamber, from which the surface or upper phase fluid may be removed to permit entry and exit of articles or materials directly into the lower phase fluid,
(b) an overflow receiving chamber;
(c) a holding chamber;
(d) a pumping chamber;
(e) a first weir means separating the lower regions of the working chamber and the receiving chamber
(f) a first separating means between the holding chamber and the working chamber having an opening in the lower region to permit fluid flow between the lower region of the holding chamber and the lower region of the working chamber;
(g) a second weir means separating the lower regions of the holding chamber and the pumping chamber;
(h) a second separating means between the receiving chamber and the pumping chamber having an opening in the lower region to permit fluid flow between the lower region of the receiving chamber and the lower region of the pumping chamber.
(i) a pumping means having an inlet side in fluid communication with the lower region of the pumping chamber and an outlet side in fluid communication with the holding chamber;
(j) an equalizing means providing fluid communication from the lower region of holding chamber or working chamber to the lower region of the pumping chamber.

When the apparatus of the invention, containing a multi-phase fluid system, is in the static condition, the less dense upper phase fluid substantially completely covers the upper surface of the lower phase fluid in all of the operating chambers. When operation of the apparatus commences, in response to the pumping means, a flow of the lower phase fluid occurs through the pumping means from the pumping chamber to the holding chamber. Within the holding chamber, the lower phase fluid flows in two directions. In one direction the lower phase fluid flows through a lower opening in the first separating means into the working chamber and upwardly therein to spill over the first weir into the overflow receiving chamber, then downwardly to return to the pumping chamber through a lower opening in the second separating means. As the fluid rises in the working chamber, the upper phase fluid is forced over the first weir into the receiving chamber with a consequent removal of the upper phase fluid by overflow from the working chamber and exposure of the lower phase fluid in that chamber. In this condition articles or materials to be treated may be caused to enter and exit the lower phase fluid within the working chamber without contacting the upper phase fluid. During this operating condition a second portion of the lower phase fluid entering the holding chamber, in response to the pumping means, flows over a second weir, back into the pumping chamber spilling through a layer of the upper phase fluid to provide a scrubbing or cleansing action. When the operation is discontinued, a return flow automatically occurs through the equalizing means until a static condition is achieved and the entire upper surface of the lower phase liquid is again covered by the upper phase fluid.

The multi-phase fluid system which may be employed in the apparatus of this invention may comprise two or more immiscible fluids of different specific gravities. The multi-phase fluid systems are described herein primarily in terms of a two phase system. It will be apparent, however, that multi-phase systems having more than two fluid phases may be employed and that flow rates and capacities of the chambers may be varied to selectively remove one or more upper phase fluids during operation. Furthermore, although the preferred fluid systems are liquid systems, it will be apparent that suitable gases may also be employed. Thus, for example, a dense gas such as carbon dioxide may be employed as the upper phase fluid to provide a protective covering over the surface of a hazardous liquid. The preferred multi-phase fluid systems are those wherein the upper phase fluid is water and the lower phase fluid is a chlorinated organic solvent such as perchloroethylene or trichloroethylene.

BRIEF DESCRIPTION OF THE DRAWINGS

For a more complete understanding of the present invention, references is made to the accompanying drawings wherein.

DETAILED DESCRIPTION OF THE DRAWINGS

Figure 1:
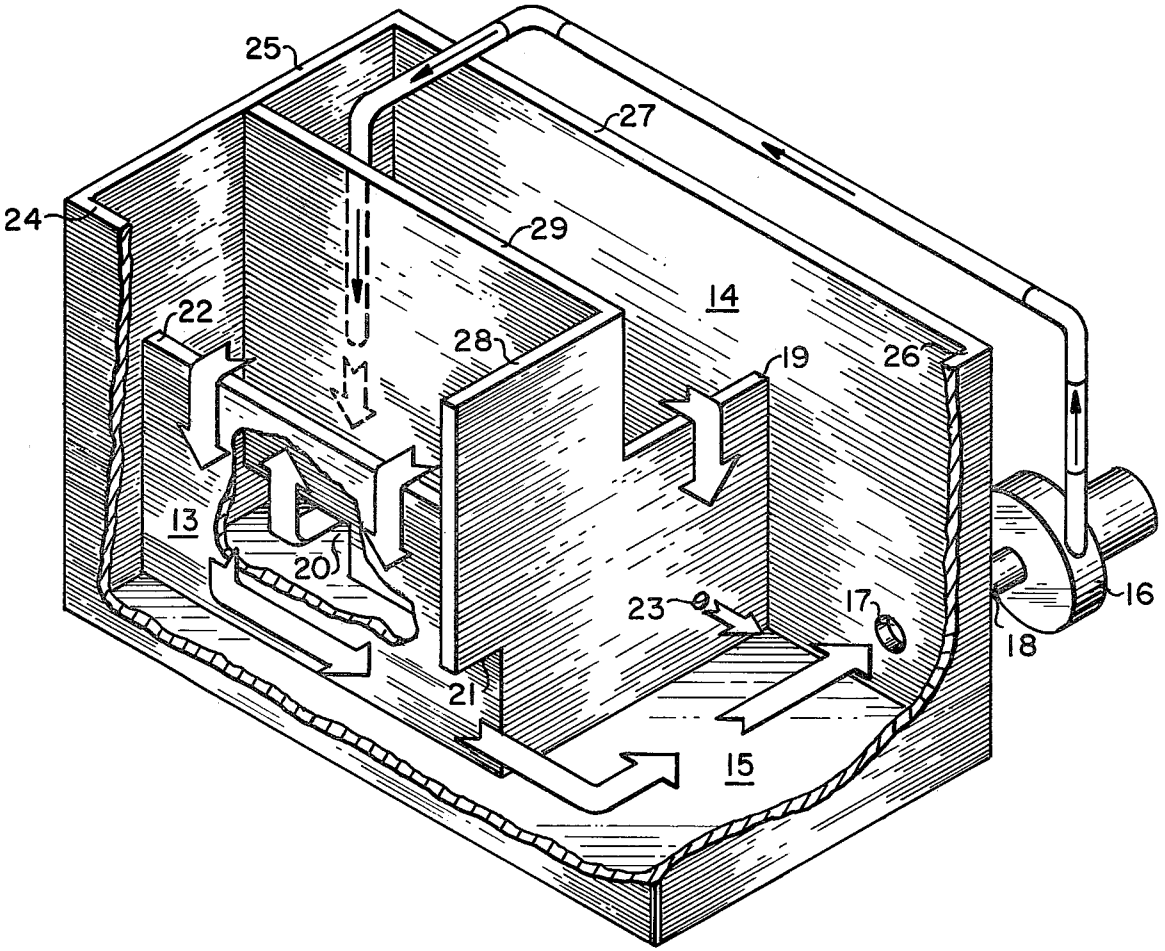
FIG. 1 is a perspective view, with portions thereof broken away for clarity, of an embodiment of a typical apparatus of this invention.

The embodiment of this invention illustrated in the drawing comprises a housing containing four operating chambers: a working chamber 12; an overflow receiving chamber 13; a holding chamber 14; and a pumping chamber 15. While the apparatus of this invention may be of an desired size or configuration, the embodiment illustrated in the drawings is that of a generally rectangular tank having a bottom wall 11, a front wall 24, sidewalls 25 and 26, and a rear wall 27. Similarly, although the operating chambers may vary considerably both in configuration and relative size, in the embodiment depicted in the accompanying drawings these chambers are diagrammatically indicated as having a generally rectangular shape. Thus, with reference to the drawings, especially FIGS. 1 and 2, the operating chambers share a common bottom wall 11. The working chamber 12 being further defined by side wall 25, interior separating means wall 28, interior separating means wall 29, and weir 22. The overflow receiving chamber 13 is further defined by side wall 25, separating means wall 28, front wall 24, and weir 22. The holding chamber is further defined by side wall 25, rear wall 27, interior separating means wall 29 and weir 19. The pumping chamber 15 is further defined by rear wall 27, side wall 26, front wall 24, interior separating means wall 28, and weir 19.

Figure 2:
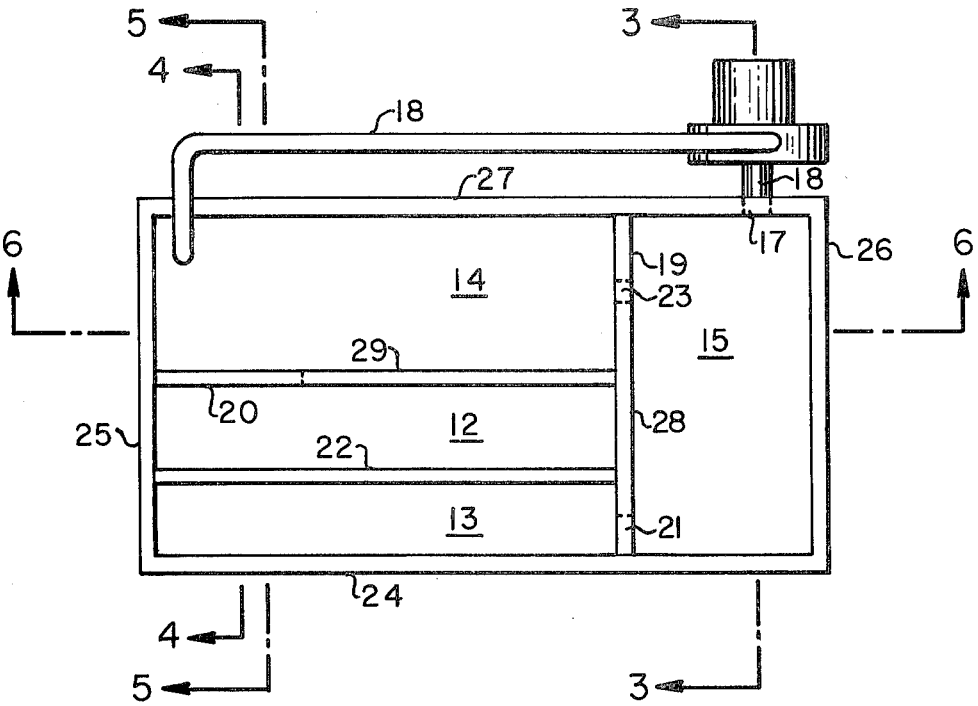
FIG. 2 is a diagrammatic top plan view of the apparatus of FIG. 1.
Figure 3:
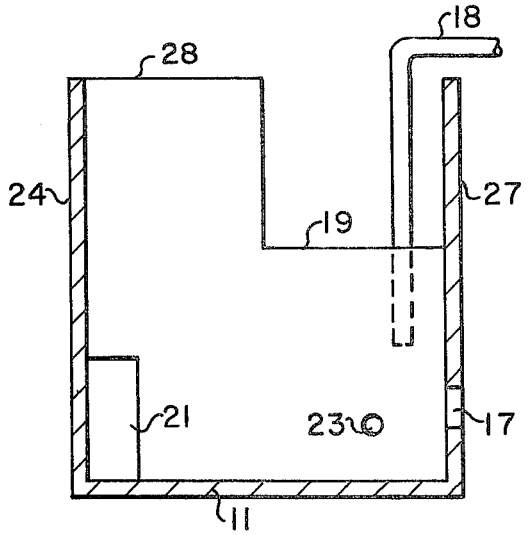
FIG. 3 is a vertical sectional view taken along the lines 3—3 of FIG. 2.

The apparatus illustrated is further provided with a pumping means 16, piping means 18, openings 17, 20 and 21, and equalizing means port 23, each positioned to provide a directed fluid flow when the apparatus is in operation. The function of each feature is best described in terms of the flow of a two-phase liquid system (not shown in FIGS. 1–3), within the apparatus.

Figure 4:
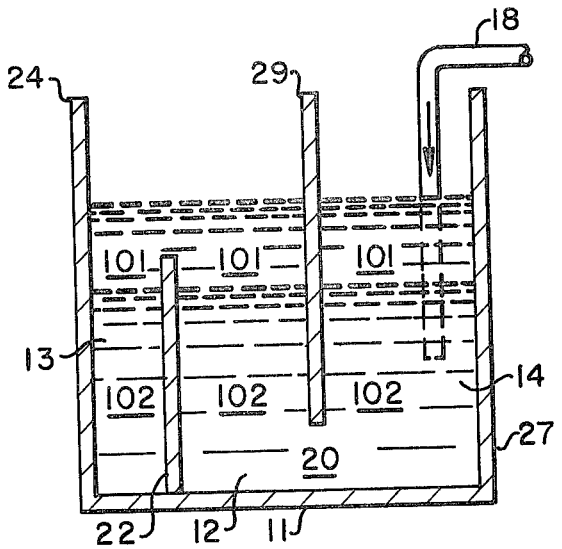
FIG. 4 is a vertical sectional view taken along the lines 4—4 of FIG. 2 and additionally illustrating a portion of the apparatus of this invention containing a two-phase fluid system, in the static condition.

In a static condition, with a two-phase liquid system, a less dense upper phase liquid covers a denser lower phase liquid in all chambers of the apparatus. The static condition, with a two-phase fluid system is shown diagrammatically in FIG. 4, which is a vertical sectional view of holding chamber 14, working chamber 12, and overflow receiving chamber 13. The two-phase fluid system comprises a less dense upper phase fluid 101, completely covering a denser lower phase fluid 102.

In operation, the movement of fluid occurs over the weirs and through the openings and pipe means in the directions shown by the arrows in FIG. 1.

Thus, with reference to FIG. 1, in operation with a two-phase liquid system, a flow of the lower phase liquid occurs in response to pumping means 16, from the pumping chamber 15 through outlet 17 and pipe 18, to the holding chamber 14. From the holding chamber a portion of the lower phase liquid flows over weir 19 to return to the pumping chamber 15. A second portion of the lower phase liquid flows through opening 20 to the bottom of working chamber 12 causing a rise of the liquid level therein. At the same time, a lowering of the liquid level in the overflow receiving chamber 13 occur as the lower phase liquid therein flows through the opening 21 into the pumping chamber 15 to be continuously re-circulated by pumping means 16. As the liquid levels rise in the working chamber 12, and fall in the overflow receiving chamber 13, the liquids in the working chamber 12 flow over weir 22 into the receiving chamber 13, removing the upper phase liquid from the working chamber.

Figure 5:
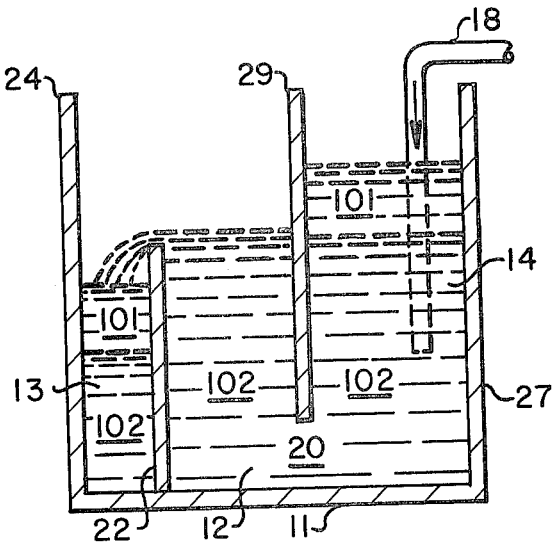
FIG. 5 is a vertical sectional view taken along the lines 4—4 of FIG. 2 and additionally illustrating a portion of the apparatus of this invention containing a two-phase fluid system, in the operating condition.
Figure 6:
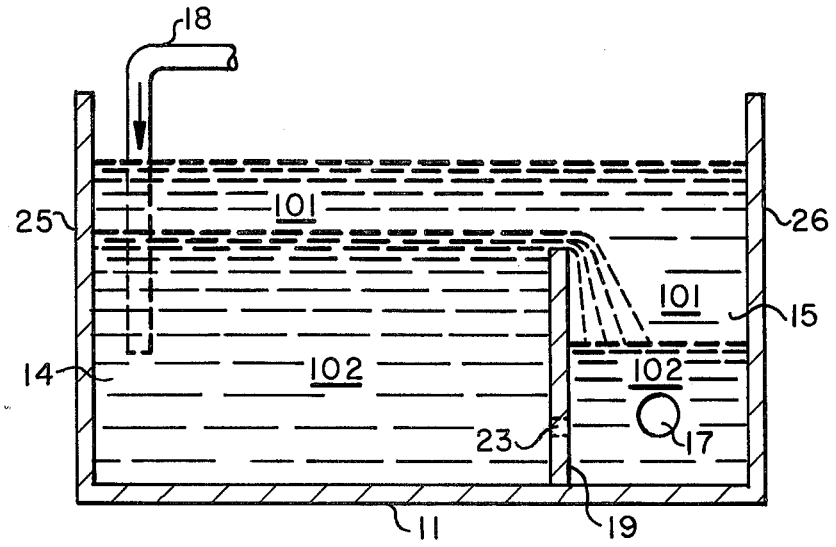
FIG. 6 is a vertical sectional view taken along the lines 6—6 of FIG. 2 and additionally illustrating a portion of the apparatus of this invention containing a two-phase fluid system, in the operating condition.

The relative positions of the liquids at the equilibrium operating condition is shown diagrammatically in FIGS. 5 and 6. FIG. 5 is a vertical sectional view of holding chamber 14, working chamber 12, and overflow receiving chamber 13. At this equilibrium operating condition, all of the upper phase liquid 101 from the working chamber 12 has flowed over weir 22 thus removing the upper phase liquid 101 from the working chamber. In this condition, articles or material (not shown) may enter and exit the lower phase liquid 102 in the working chamber 12 without contacting the upper phase liquid. At this equilibrium operating condition the upper phase liquid 101 from the working chamber 12 is held in the overflow receiving chamber 13 at a level below weir 22 and above opening 21 (not shown in FIG. 5).

FIG. 6 is a vertical sectional view of pumping chamber 15 and holding chamber 14. At this equilibrium operating condition the lower phase liquid 102 is flowing out of opening 17, through pumping means (not shown) and pipe 18 into holding chamber 14 permitting a return flow from holding chamber 14 over weir 19. As the lower phase liquid level 102 rises in the in the holding chamber 14 and falls in the pumping chamber 15 a portion of the upper phase liquid 101 flows over weir 19 and is stored in the pumping chamber 15 between upper edge of weir 19 and the lowered surface of lower phase 102. In this condition the depth of the upper phase liquid 101 is relatively greater in the pumping chamber 15 than in the holding chamber 14. As the flow of lower phase liquid through the pumping means (not shown in FIG. 6) continues, the liquid levels rise in the holding chamber 14 and the lower phase liquid 102 spills over weir 19 into the pumping chamber 15 where it passes by gravity through the enlarged layer of upper phase liquid 101 to the lower regions of the pumping chamber. In this manner, the lower phase liquid 102 undergoes a scrubbing or cleansing action by the upper phase liquid 101 in the pumping chamber as it passes therethrough. During the operation the lower phase liquid in this portion of the apparatus is at all times covered by the upper phase liquid.

During the operating condition, a relatively small return flow of lower phase liquid 102 occurs from the holding chamber 14 to the pumping chamber 15 through equalizing means port 23.

When the operating condition is discontinued and the operation of the pump 16 is stopped the liquids return automatically to their static condition wherein the lower phase liquid is completely covered by the upper phase liquid. With the stopping of the pump 16, the denser lower phase liquid 102 that has been at an elevated level in the holding chamber 14 returns by gravity flow through equalizing port 23 to the pumping chamber 15 and then through opening 21 into the overflow receiving chamber 13 raising the liquid level therein until the upper phase liquid 101 flows back over weir 22 and covers the lower phase liquid 102 in the working chamber 12.

The apparatus of this invention may be formed of an suitable material consistent with the properties of the fluids to be handled and the temperature and corrosive conditions to which it will be subjected during use. Suitable materials include for example stainless steel, iron, or other metal, glass, plastic materials or the like.

The apparatus of this invention is described herein as an integral unit, such as a tank, subdivided into various operating chambers with provision for directed fluid communication through or over various openings, channels, weirs and the like. It will be appreciated however, that the apparatus may also be constructed in the form of separate units, each constituting an operating chamber with provision for fluid communication with the other operating chambers through appropriately placed conduits or the like.

In operation, the exposure of the lower phase liquid to the atmosphere occurs only in the working chamber, and thus evaporative losses and the formation of noxious or hazardous vapors are minimized. The working chamber may be of an suitable size, having a surface area and configuration consistent with the requirements of size and shape of the articles to be treated therein. The articles may be immersed in the working chamber individually, in batches or groups, or continuously, as in a moving belt, cable, or chain, entering and leaving the area at a rate dependent on the residence time required for a particular treatment.

For most purposes, it is preferred that the area of the working chamber be relatively small compared to the total area of the other chambers.

When the total area (and consequently the total volume) of the apparatus is large relative to that of the working chamber, an additional advantage is derived in terms of temperature control. Thus, while the exposure of the lower phase liquid is minimized, that liquid may still be employed in a sufficiently large volume and mass that temperature fluctuations are reduced and a relatively constant temperature may be conveniently maintained. In addition, the larger volume of lower phase liquid allows for a longer operating period without the need for replacing or replenishing of that liquid due to depletion or contamination.

The apparatus of this invention may be constructed with a single working chamber, or with multiple, separate working chambers. In one embodiment, for example, two relatively small working chambers may be employed with provision for a continuously moving belt, cable, chain or the like of materials or articles to be treated entering one working chamber, moving along a desired internal route through the lower phase liquid and exiting through the other working chamber.

In the accompanying illustrations the equalizing means is shown as a port providing fluid communication between the lower region of the holding chamber and the lower region of the pumping chamber to permit a return flow of lower phase fluid and an automatic re-establishment of liquid levels to the static condition when operation of the pumps is discontinued. In an alternative embodiment of this invention, the same purpose is achieved when the equalizing means is positioned to provide fluid communication between the lower region of the working chamber and the lower region of the pumping chamber the equalizing means may be positioned directly in the interior separating means wall 28 or second weir 19 or may be provided in the form of an external conduit between the chambers. It is preferred that the equalizing means be of such cross-sectional area as to provide a relatively small flow rate relative to the flow rate through the pumping means, or other conduits or openings in the apparatus.

Flow of the lower phase fluid occurs in response to a pumping means which may constitute an external pump and conduit having an inlet side at the pumping chamber and an outlet side at the holding chamber, as shown in the accompanying drawings. However, it will be apparent that various other pumping arrangements may be employed to accomplish the desired fluid flow. Thus, for example, a submersible pump may be employed internally with suitable conduits leading internally from the pumping chamber to the holding chamber. In another alternative embodiment a pump means providing for level or horizontal flow between the pumping chambers and the holding chamber may also serve as the equalizing means when the pump is stopped. The pump means would then serve as an equalizing means conduit for return flow from the holding chamber to the pumping chamber when the apparatus is in the static condition.

Optionally, one or more filter means may be incorporated to filter the fluid system during operation. Thus, for example, a filter means may be conveniently incorporated in series with the pumping means, in a known manner, to provide a constant filtering of the lower phase liquid during operation. Alternatively, a filter means may be incorporated separately from the pumping means for either continuous or intermittent filtering operation. Similarly, a pump and filter means may be incorporated in the apparatus in a known manner for constant or intermittent filtering of the upper phase liquid.

Various other embodiments are contemplated within the scope of this invention. For example, the pumping means may be a variable speed pump to provide for any desired flow rate. The lower openings through which the lower phase fluid flows may be variable or adjustable in size to provide for adjustments in flow rate for example, into the working chamber or into the pumping chamber. Furthermore, additional controlled variation of flow within the various chambers of the apparatus may be provided through the use of adjustable weirs, which may be conveniently adjusted in height or width.

While there have been described various embodiments of the present invention, it is to be understood that the specific materials, methods and configurations referred to, are merely exemplary of the present invention and the manner in which it may be practiced, and that the details disclosed herein may be modified without departing from the spirit and scope of the invention.

What is claimed is:

1. An apparatus for a multi-phase fluid system having an upper phase fluid and a lower phase fluid wherein, in a static condition the upper phase fluid covers the upper surface of the lower phase fluid and in an operating condition the upper phase fluid is removed from a preselected portion thereof; said apparatus comprising:

(a) a working chamber;
(b) an overflow receiving chamber;
(c) a holding chamber;
(d) a pumping chamber; each of said chambers having a lower region and an upper region;
(e) a first weir means separating the lower region of the working chamber and the receiving chamber;
(f) a first separating means between the holding chamber and the working chamber having an opening in the lower region thereof to permit fluid flow between the lower region of the holding chamber and the lower region of the working chamber;
(g) a second weir means separating the lower region of the holding chamber and the pumping chamber;
(h) a second separating means between the receiving chamber and the pumping chamber having an opening in the lower region to permit fluid flow between the lower region of the receiving chamber and the lower region of the pumping chamber;
(i) a pumping means having an inlet side in fluid communication with the lower region of the pumping chamber and an outlet side in fluid communication with the lower region of holding chamber;
(j) an equalizing means providing fluid communication from the lower region of holding chamber to the lower region of the pumping chamber.

2. The apparatus of claim 1 comprising an integral unit sub-divided into four operating chambers, said four operating chambers including (a) said working chamber, (b) said overflow receiving chamber, (c) said holding chamber and (d) said pumping chamber.

3. The apparatus of claim 2 comprising a tank having a bottom and four sidewalls and subdivided into four operating chambers.

4. The apparatus of claim 2 wherein the equalizing means comprises an equalizing port in the second weir means to provide fluid communication between the lower region of the holding chamber and the lower region of the pumping chamber.

5. The apparatus of claim 2 wherein the equalizing means provides fluid communication between the working chamber and the pumping chamber.

6. The apparatus of claim 2 wherein the equalizing means provides fluid communication from the holding chamber and the working chamber to the pumping chamber.

7. The apparatus of claim 2 wherein the pumping means is exterior to the pumping chamber.

8. The apparatus of claim 2 wherein a filter means is provided for filtering a lower phase liquid.

* * * * *